US008480453B2

(12) United States Patent
Kobayashi

(10) Patent No.: US 8,480,453 B2
(45) Date of Patent: Jul. 9, 2013

(54) DIE GRINDER WITH ROTATABLE HEAD

(75) Inventor: Shigeki Kobayashi, Nagano (JP)

(73) Assignee: SP Air Kabushiki Kaisha, Kamiminochi-Gun, Nagano (JP)

( * ) Notice: Subject to any disclaimer, the term of this patent is extended or adjusted under 35 U.S.C. 154(b) by 1335 days.

(21) Appl. No.: 11/622,380

(22) Filed: Jan. 11, 2007

(65) Prior Publication Data

US 2007/0141967 A1 Jun. 21, 2007

Related U.S. Application Data

(63) Continuation-in-part of application No. 11/279,180, filed on Apr. 10, 2006, now abandoned.

(60) Provisional application No. 60/727,074, filed on Oct. 14, 2005.

(51) Int. Cl.
*B24B 23/02* (2006.01)

(52) U.S. Cl.
USPC ..... 451/11; 81/57.13; 451/344

(58) Field of Classification Search
USPC . 451/11–14, 18, 23, 344, 358, 359; 81/57.13, 81/177.85, 11–14, 18, 23, 344, 358, 57.26, 81/57.39, 177.8, 57.29, 57.28
See application file for complete search history.

(56) References Cited

U.S. PATENT DOCUMENTS 928,375 A 7/1909 Frick
978,395 A 12/1910 Peters
1,000,878 A 8/1911 Allen
1,019,825 A 3/1912 Mossberg
1,080,121 A 12/1913 Oriol
1,109,032 A 9/1914 Bersted
1,178,287 A 4/1916 Anderson
1,198,822 A 9/1916 Capel
1,265,535 A 5/1918 Shannon
1,324,258 A 12/1919 Lewis
1,325,407 A 12/1919 Morgan
1,568,442 A 1/1926 Carver
1,840,685 A 1/1932 Witherup
1,975,695 A 10/1934 Lund
2,073,903 A 3/1937 O'Neil (Continued)

FOREIGN PATENT DOCUMENTS

JP 56157962 12/1981
JP 8281572 A 10/1996

(Continued)

OTHER PUBLICATIONS

Office action dated Jan. 18, 2007 regarding U.S. Appl. No. 11/279,180, 21 pages.

(Continued)

*Primary Examiner* — Hadi Shakeri
(74) *Attorney, Agent, or Firm* — Senniger Powers LLP

(57) ABSTRACT

A die grinder including a body having a longitudinal axis, and a grinding head portion with an output shaft capable of powered rotation. A motor is disposed in the body for rotating the output member. A locking interconnect portion attaches the grinding head portion to the body and is adapted to permit selective rotation of the grinding head portion relative to the body about the longitudinal axis of the body. Thus, the grinding head can be positioned at different selected angles relative to the body.

14 Claims, 20 Drawing Sheets

U.S. PATENT DOCUMENTS

| | | | |
|---|---|---|---|
| 2,235,434 | A | 3/1941 | Kincaid |
| 2,264,012 | A | 11/1941 | Wasson |
| 2,268,802 | A | 1/1942 | Coffman |
| 2,498,465 | A | 2/1950 | Thomas |
| 2,499,569 | A | 3/1950 | Cooley |
| 2,501,217 | A | 3/1950 | Hawn |
| 2,669,147 | A | 2/1954 | Koenig |
| 2,705,897 | A | 4/1955 | Kentish |
| 2,712,256 | A | 7/1955 | Fish |
| 2,791,142 | A | 5/1957 | Lyon |
| 2,881,884 | A | 4/1959 | Amtsberg |
| D186,290 | S | 10/1959 | Hitchcock et al. |
| 2,921,773 | A | 1/1960 | Hoelzer |
| 3,190,183 | A | 6/1965 | Walker et al. |
| 3,233,481 | A | 2/1966 | Bacon |
| 3,256,758 | A | 6/1966 | Medesha |
| 3,257,877 | A | 6/1966 | Ulrich et al. |
| 3,270,595 | A | 9/1966 | Hall et al. |
| D214,776 | S | 7/1969 | Schaedler |
| 3,529,498 | A | 9/1970 | Northcutt |
| 3,605,914 | A | 9/1971 | Kramer |
| 3,608,383 | A | 9/1971 | Hunter et al. |
| 3,661,217 | A | 5/1972 | Maurer |
| 3,779,107 | A | 12/1973 | Avery |
| 3,867,855 | A | 2/1975 | Siebert |
| 4,075,913 | A | 2/1978 | Tye |
| 4,171,651 | A | 10/1979 | Dacunto |
| 4,259,883 | A | 4/1981 | Carlson |
| 4,287,795 | A | 9/1981 | Curtiss |
| D261,097 | S | 10/1981 | Wallace et al. |
| 4,296,654 | A | 10/1981 | Mercer |
| 4,299,145 | A | 11/1981 | Rautio et al. |
| D265,962 | S | 8/1982 | Izumisawa |
| 4,346,630 | A | 8/1982 | Hanson |
| D269,938 | S | 8/1983 | Izumisawa |
| 4,406,186 | A | 9/1983 | Gummow |
| 4,458,565 | A | 7/1984 | Zilly et al. |
| D278,407 | S | 4/1985 | Fleischer, Jr. |
| 4,528,873 | A | 7/1985 | Lee |
| 4,530,261 | A | 7/1985 | Ventura |
| 4,530,262 | A | 7/1985 | Pownall |
| 4,532,832 | A | 8/1985 | Christensen |
| 4,535,850 | A | 8/1985 | Alexander |
| 4,552,544 | A | 11/1985 | Beckman et al. |
| D289,135 | S | 4/1987 | Doman |
| 4,680,994 | A | 7/1987 | Singleton |
| 4,722,252 | A | 2/1988 | Fulcher et al. |
| 4,747,328 | A | 5/1988 | Howard |
| 4,748,872 | A | 6/1988 | Brown |
| 4,791,836 | A | 12/1988 | D'Haem et al. |
| 4,794,829 | A | 1/1989 | Mesenhoeller |
| 4,821,611 | A | 4/1989 | Izumisawa |
| 4,822,264 | A | 4/1989 | Kettner |
| D302,378 | S | 7/1989 | Nelson |
| 4,854,197 | A | 8/1989 | Walton |
| 4,856,385 | A | 8/1989 | Ogilvie et al. |
| 4,901,608 | A | 2/1990 | Shieh |
| 4,974,475 | A | 12/1990 | Lord et al. |
| 4,987,803 | A | 1/1991 | Chern |
| 4,993,288 | A | 2/1991 | Anderson et al. |
| D316,216 | S | 4/1991 | Gierke et al. |
| D320,540 | S | 10/1991 | Staubitz et al. |
| D320,541 | S | 10/1991 | Staubitz et al. |
| D323,275 | S | 1/1992 | Sasaki et al. |
| D327,620 | S | 7/1992 | Fisher |
| D330,151 | S | 10/1992 | Fisher |
| D333,077 | S | 2/1993 | Mikiya |
| D333,766 | S | 3/1993 | Albert et al. |
| D334,124 | S | 3/1993 | Izumisawa |
| D334,125 | S | 3/1993 | Izumisawa |
| 5,231,901 | A | 8/1993 | Putney et al. |
| D339,726 | S | 9/1993 | Bruno et al. |
| 5,293,747 | A | 3/1994 | Geiger |
| D347,372 | S | 5/1994 | Ghode et al. |
| 5,346,024 | A | 9/1994 | Geiger et al. |
| 5,383,771 | A | 1/1995 | Ghode et al. |
| D357,848 | S | 5/1995 | Izumisawa |
| 5,419,221 | A | 5/1995 | Cole |
| D361,028 | S | 8/1995 | Izumisawa |
| 5,450,773 | A | 9/1995 | Darrah et al. |
| D363,420 | S | 10/1995 | Warner |
| 5,535,646 | A | 7/1996 | Allen et al. |
| 5,537,899 | A | 7/1996 | Diedrich |
| 5,562,015 | A | 10/1996 | Zinck |
| 5,577,425 | A | 11/1996 | Holmin et al. |
| D376,083 | S | 12/1996 | Verdura et al. |
| 5,584,220 | A | 12/1996 | Darrah et al. |
| D380,658 | S | 7/1997 | Bruno et al. |
| 5,709,136 | A * | 1/1998 | Frenkel ..... 81/57.13 |
| 5,738,192 | A | 4/1998 | Miner |
| 5,775,981 | A * | 7/1998 | Yang ..... 451/358 |
| 5,784,934 | A | 7/1998 | Izumisawa |
| D408,243 | S | 4/1999 | Izumisawa |
| 5,906,244 | A | 5/1999 | Thompson et al. |
| 5,911,800 | A * | 6/1999 | Roberts et al. ..... 81/177.85 |
| 5,992,540 | A | 11/1999 | Smolinski et al. |
| D435,204 | S | 12/2000 | Izumisawa |
| 6,167,787 | B1 | 1/2001 | Jarvis |
| D439,485 | S | 3/2001 | Izumisawa |
| D439,486 | S | 3/2001 | Izumisawa |
| D440,847 | S | 4/2001 | Izumisawa |
| D440,848 | S | 4/2001 | Izumisawa |
| 6,308,594 | B1 | 10/2001 | Cheng |
| 6,311,583 | B1 | 11/2001 | Izumisawa |
| 6,568,298 | B1 | 5/2003 | Zinck |
| 6,578,643 | B2 | 6/2003 | Izumisawa |
| 6,715,380 | B2 | 4/2004 | Listl et al. |
| 6,789,447 | B1 | 9/2004 | Zinck |
| 6,860,174 | B2 | 3/2005 | Kusama |
| 6,928,902 | B1 | 8/2005 | Eyssallenne |
| 6,962,523 | B2 * | 11/2005 | Fraser et al. ..... 451/259 |
| 2005/0051002 | A1 | 3/2005 | Brun |

FOREIGN PATENT DOCUMENTS

| | | | |
|---|---|---|---|
| JP | 2000015584 | A | 1/2000 |
| JP | 3032006 | | 4/2000 |
| JP | 2001287176 | A | 10/2001 |

OTHER PUBLICATIONS

Office action dated May 25, 2007 regarding U.S. Appl. No. 11/279,180, 6 pages.

Office action dated Oct. 22, 2007 regarding U.S. Appl. No. 11/279,180, 5 pages.

Japanese Office action dated Mar. 1, 2011 regarding Application No. 2008-004346, 3 pages.

* cited by examiner

DIE GRINDER WITH ROTATABLE HEAD

CROSS-REFERENCE TO RELATED APPLICATION

This application is a continuation-in-part of U.S. application Ser. No. 11/279,180, filed Apr. 10, 2006 which is the non-provisional of U.S. Provisional Application No. 60/727,074 filed Oct. 14, 2005, the entireties of which are herein incorporated by reference.

BACKGROUND OF THE INVENTION

The present invention relates generally to die grinders and, more specifically, to a die grinder tool having a rotatable head.

Powered die grinders such as pneumatic die grinders rotate an output member with a grinder head for smoothing, shaping, and/or polishing metal surfaces. In general, pneumatic die grinders have a cylindrical housing designed to be held in a user's hand such that the user's fingers engage a trigger lever pivotally secured at a lower portion of the housing. In this way, the user can easily operate the grinder (i.e., depress the trigger lever) by squeezing the trigger lever with her fingers.

The trigger lever is typically located on the same side of the grinder as the output member. Therefore, to maneuver the grinder so that the grinding head on the output member engages a surface being worked, the user has to adjust her wrist or arm or entire body to properly position the tool. However, in some situations, such as when the user is trying to work on a surface that is hard to reach and/or is partially obstructed by other components or structures, there may not be enough space or room to adjust her wrist or arm or body. Thus, the user may have to change his or her grip on the tool, such as by improperly placing the palm of her hand over the trigger instead of her fingers. Changing the grip in this manner, however, makes it more difficult to both control the ratchet and squeeze the trigger lever.

SUMMARY OF THE INVENTION

In one aspect, a die grinder tool generally comprises a body having a longitudinal axis and a die grinder head including a rotary mechanism with an output member capable of powered rotation. A motor disposed in the housing is operatively connected to the rotary mechanism for rotating the output member. A locking interconnect for attaching the die grinder head to the body is adapted to permit rotation of the head relative to the body about the longitudinal axis of the body.

In another aspect, a pneumatic die grinder tool comprises a body having a longitudinal axis and a die grinder head including a rotary mechanism with an output member capable of powered rotation. An air motor disposed in the body is operatively connected to the rotary mechanism for rotating the output member. An air inlet is adapted to be coupled with a source of pressurized air for powering the air motor. A coupling for attaching the die grinder head to the body is adapted to permit rotation of the die grinder head relative to the body about the longitudinal axis of the body.

In a further aspect, a powered tool generally comprises a body having a longitudinal axis and a head including a rotary mechanism with an output member capable of powered rotation. A motor disposed in the body is operatively connected to the rotary mechanism for rotating the output member. A locking interconnect for attaching the head to the body is adapted to selectively permit rotation of the head relative to the body generally about the longitudinal axis of the body.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
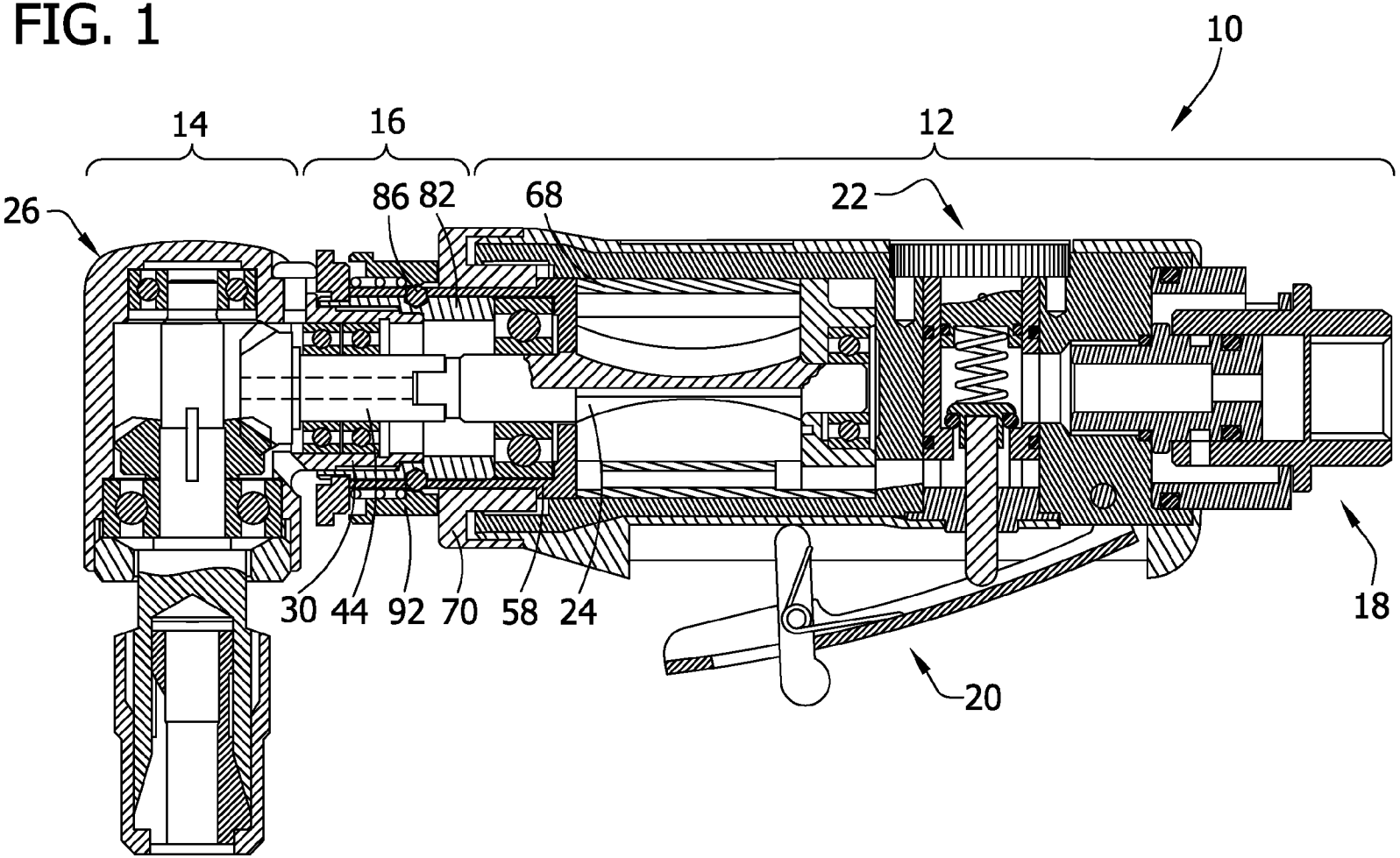
FIG. 1 is a longitudinal section of an embodiment of a die grinder according to the invention.

A die grinder 10 according to the invention is illustrated in FIGS. 1-17. As shown in FIG. 1, the die grinder 10 includes a generally cylindrical body 12, a grinding head portion 14, and a locking interconnect portion 16 which permits the angle of the grinding head portion 14 relative to the body 12 to be reoriented. In the illustrated embodiment, the die grinder 10 is a pneumatic die grinder. As such, the die grinder 10 includes within the body 12 air motor components that are illustrated but not described in detail herein (because such components are within the range of knowledge of those having skill in the art), including an air inlet 18 configured to be connected to a source of pressurized air; a trigger 20 and pneumatic valve assembly 22; and a spindle 24 that is caused to rotate at high speed by the flow of pressurized air. It will be appreciated, however, that other means for powering the die grinder, e.g., an electric motor, may be employed without departing from the scope of the invention, as will be appreciated by those having skill in the art.

As further illustrated in FIGS. 1-5, the grinding head portion 14 of the die grinder 10 includes a grinding head housing 26, which includes a generally cylindrical grinding head housing body 28 and a generally cylindrical grinding head coupling tube 30 that intersects the grinding head housing body 28 at a right angle. The grinding head housing body 28 and the grinding head coupling tube 30 are both hollow, such that a generally L-shaped passage 32 is defined through the grinding head housing 26, and external threads 33 are formed on an exterior surface of the grinding head coupling tube 30. An output shaft 34, which may be of two-piece construction, is supported for rotation within the grinding head housing body 28, e.g., by bearings 36 and 38, and a grinding head 40 is disposed at the distal end of the output shaft 34 in any suitable manner. A bevel gear 42 is mounted on and surrounds the output shaft 34 at a generally medial location, also in any suitable manner.

Furthermore, a rotary power transmission mechanism housed within the grinding head coupling tube 30 couples the spindle 24 to the output shaft 34 such that rotation of the spindle causes rotation of the output shaft 34. In particular, a driveshaft 44 (FIGS. 1, 2, 6, and 7) is supported for rotation within the grinding head coupling tube 30, e.g., by bearings 46 and 48. A slot 50 is formed in the proximal end of the driveshaft 44, and a generally rectangular spindle extension 52 is received within the slot 50 to couple the spindle 24 to the driveshaft 44. A generally frustoconical driveshaft head 54 is formed at the opposite, distal end of the driveshaft 44, and a bevel gear 56 is formed around the circumference of the driveshaft head 54. The bevel gear 56 on the driveshaft head 54 engages the bevel gear 42 surrounding the output shaft 34 such that rotation of the spindle 24 and driveshaft 44 about a first axis of rotation causes rotation of the output shaft 34 and grinding head 40 about a second axis of rotation that is oriented at an angle (e.g., 90°) relative to the first axis of rotation, as will be understood by those having skill in the art.

As noted above, the locking interconnect portion 16 is configured to permit the angle of the grinding head portion 14 relative to the body 12 to be selectively reoriented. The mechanism which facilitates that feature will now be described with reference to FIGS. 1, 2, and 8-17.

Figure 2:
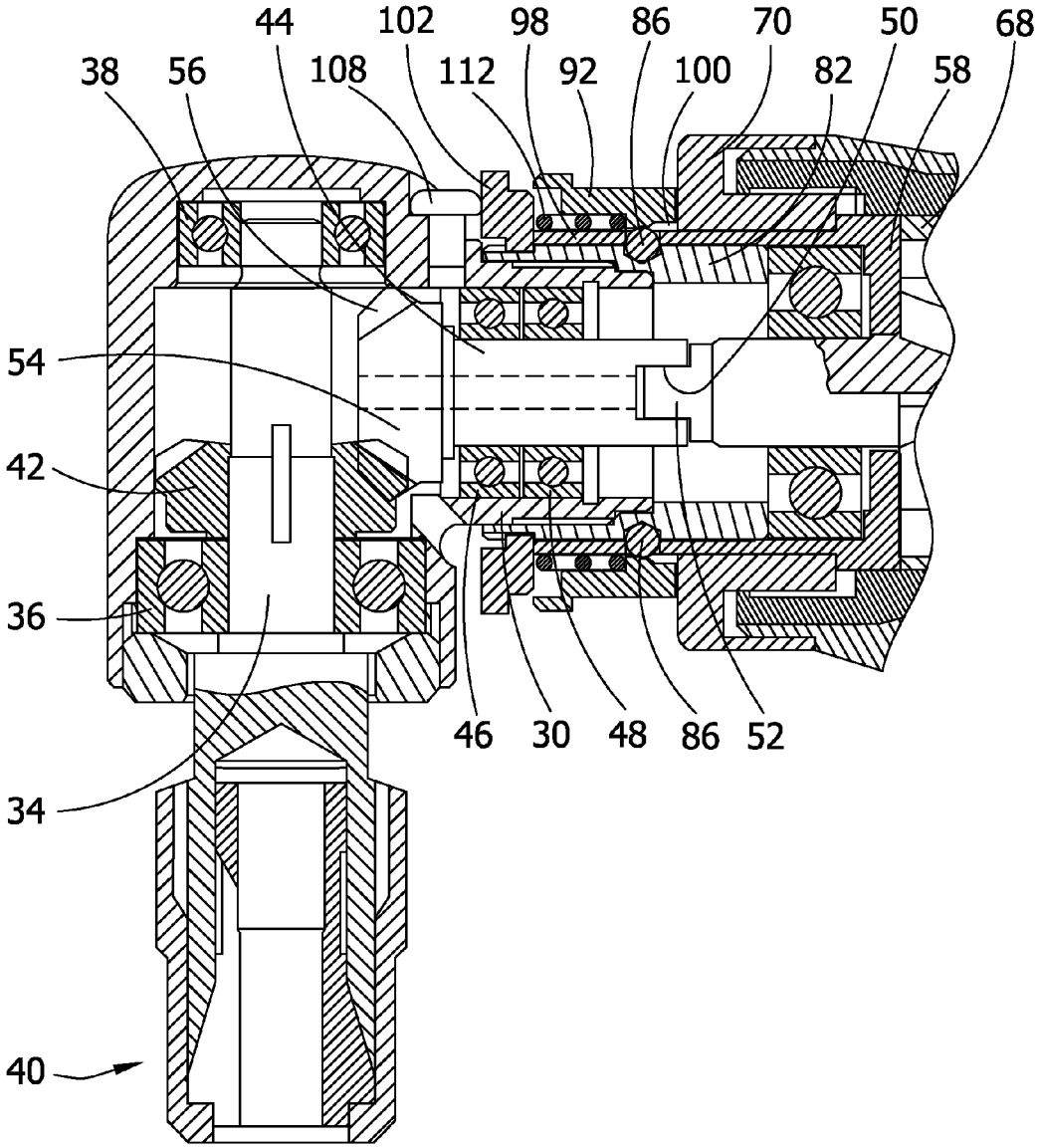
FIG. 2 is an enlarged fragment of FIG. 1 showing the grinding head portion and locking interconnect portion of the die grinder shown in FIG. 1.
Figure 3:
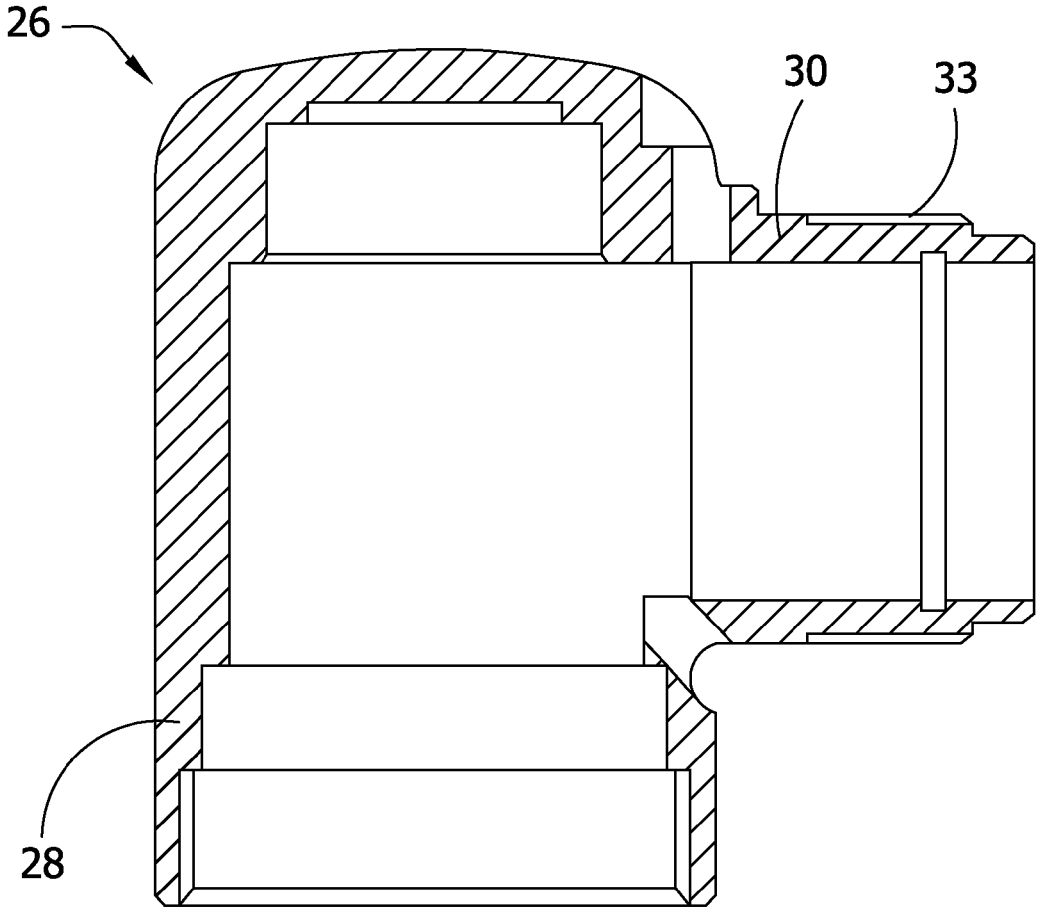
FIG. 3 is a section of a grinding head housing used in the die grinder.
Figure 4:
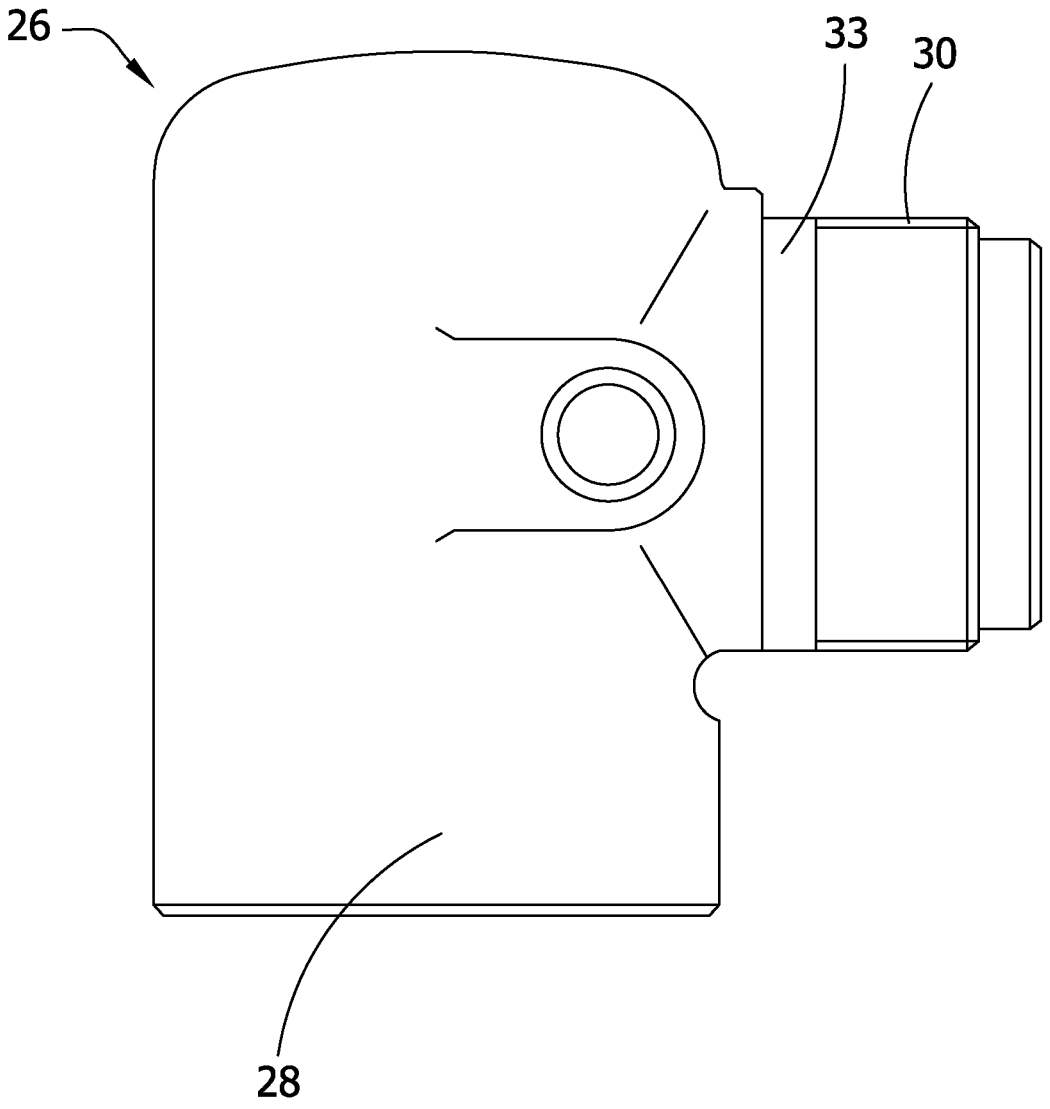
FIG. 4 is a side elevation thereof.
Figure 5:
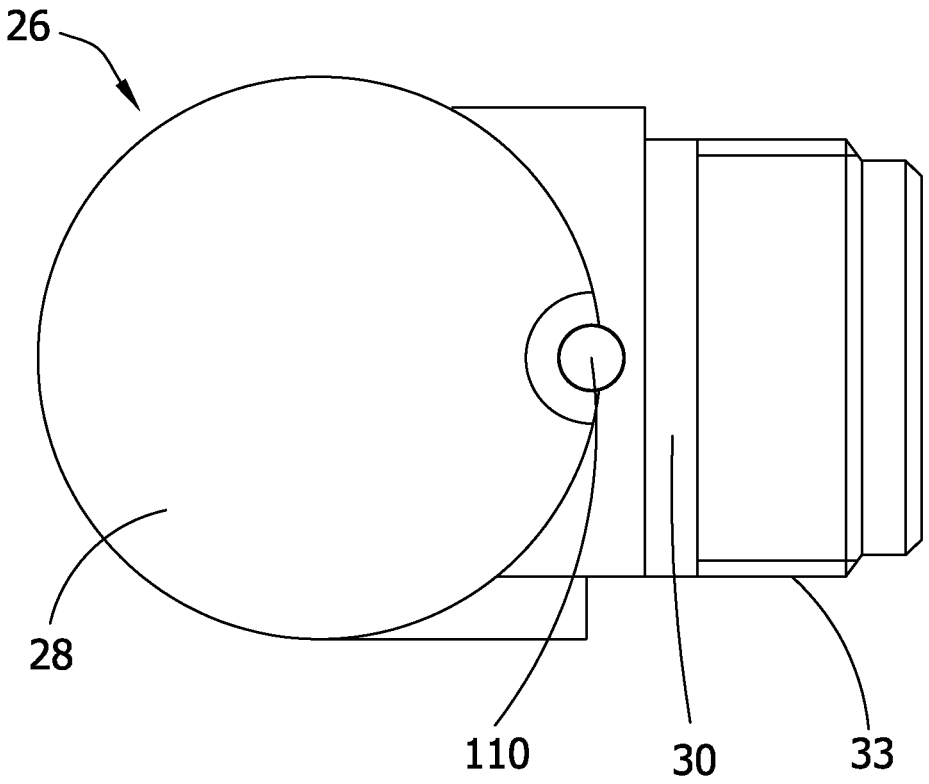
FIG. 5 is a top plan view thereof.
Figure 6:
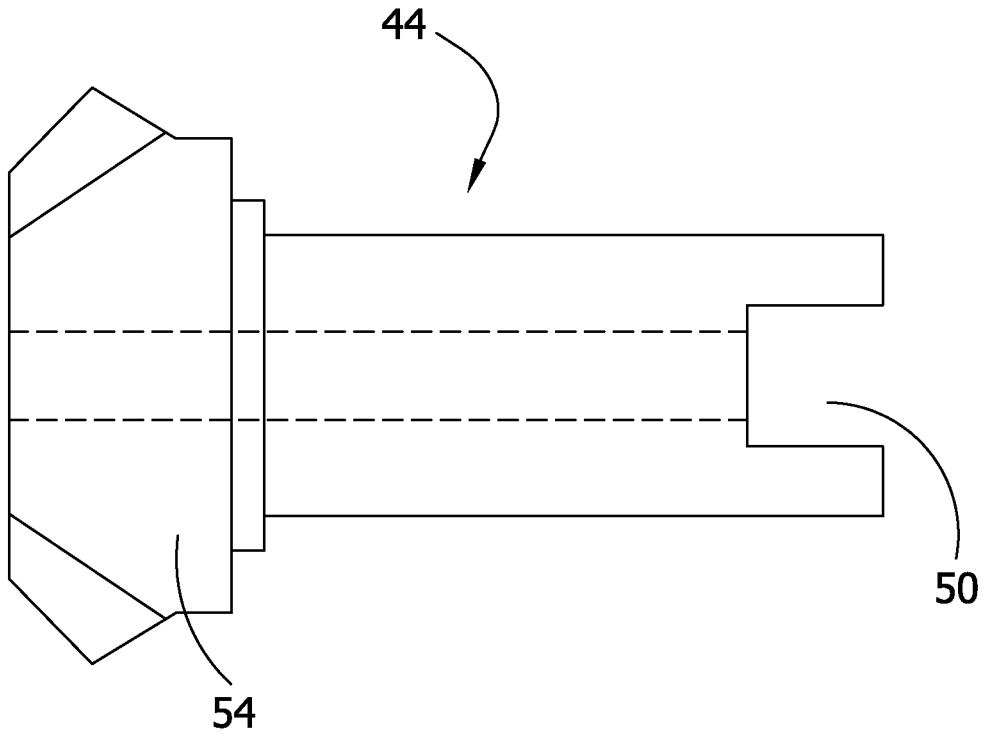
FIG. 6 is a side elevation of a driveshaft of the die grinder.
Figure 7:
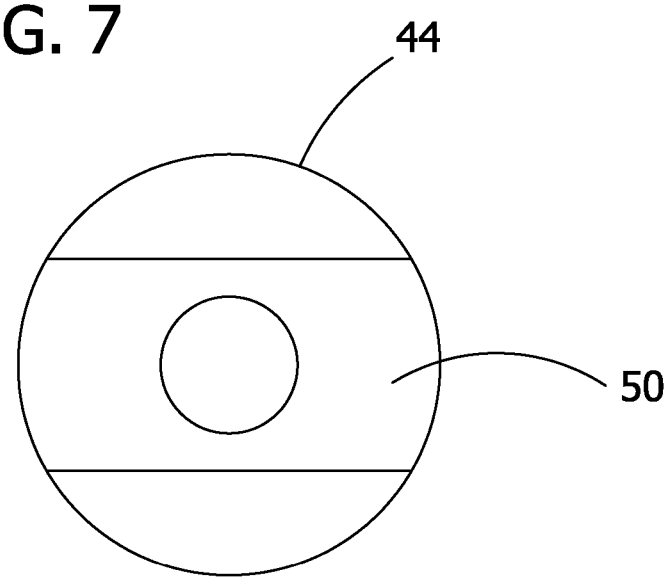
FIG. 7 is an end elevation of the driveshaft.

As shown in FIGS. 1 and 2, a generally cup-shaped body closure member 58 is received within the open distal end of the body 12. As shown in greater detail in FIGS. 8 and 9, the body closure member 58 includes an annular end wall 60 and a cylindrical tube 62 (broadly, a capture member) extending from the end wall 60. The end wall 60 has a central hole 64 through which the spindle 24 passes, and the outer diameter of the end wall 60 is greater than the outer diameter of the cylindrical tube 62 so as to form a circumferential shoulder 66. Insertion of the body closure member 58 into the open distal end of the body 12 is limited by abutment of end wall 60 against air motor sleeve 68.

Figure 10:
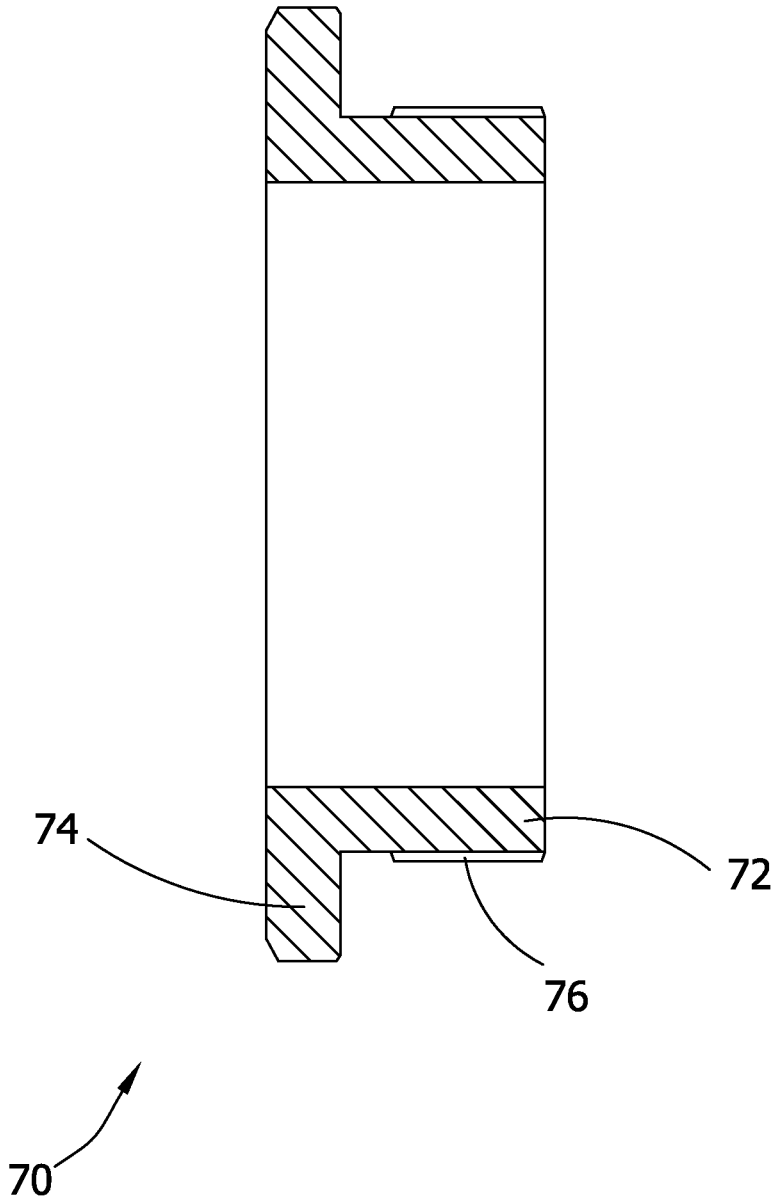
FIG. 10 is a section of an end cap used in the die grinder.
Figure 11:
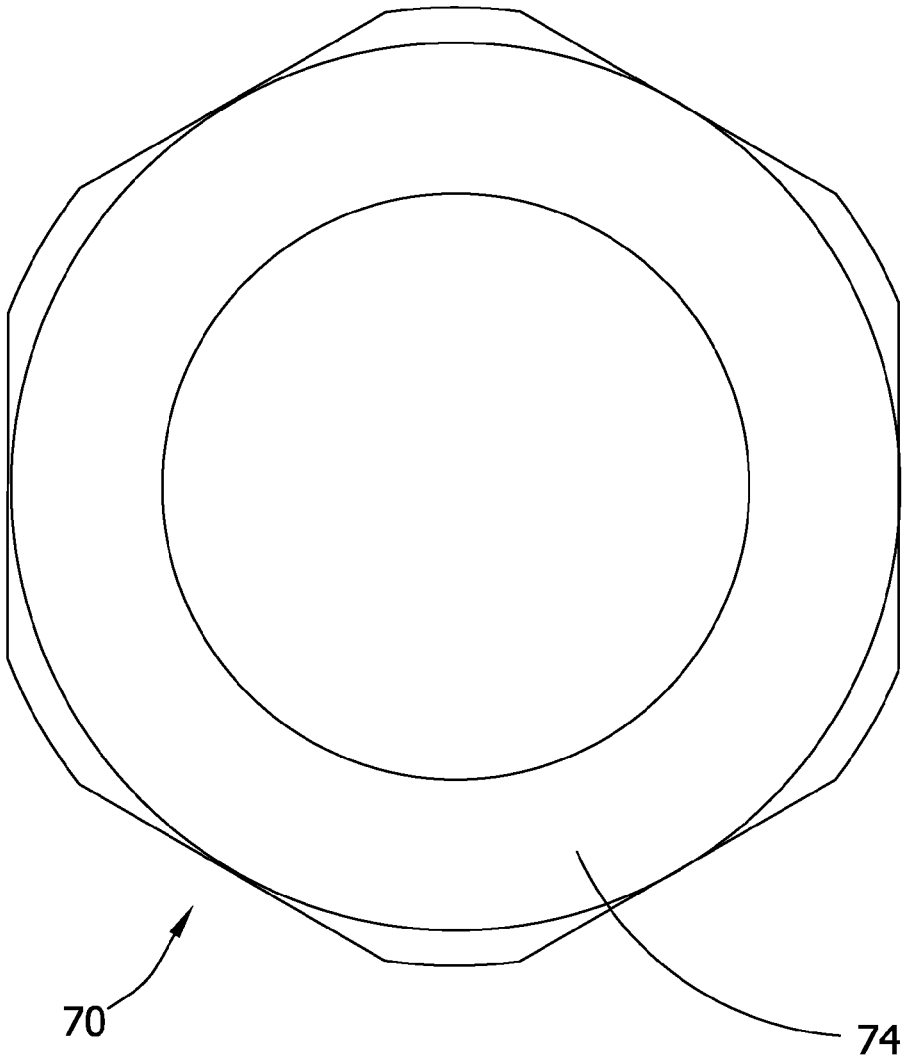
FIG. 11 is an end elevation of the end cap.
Figure 12:
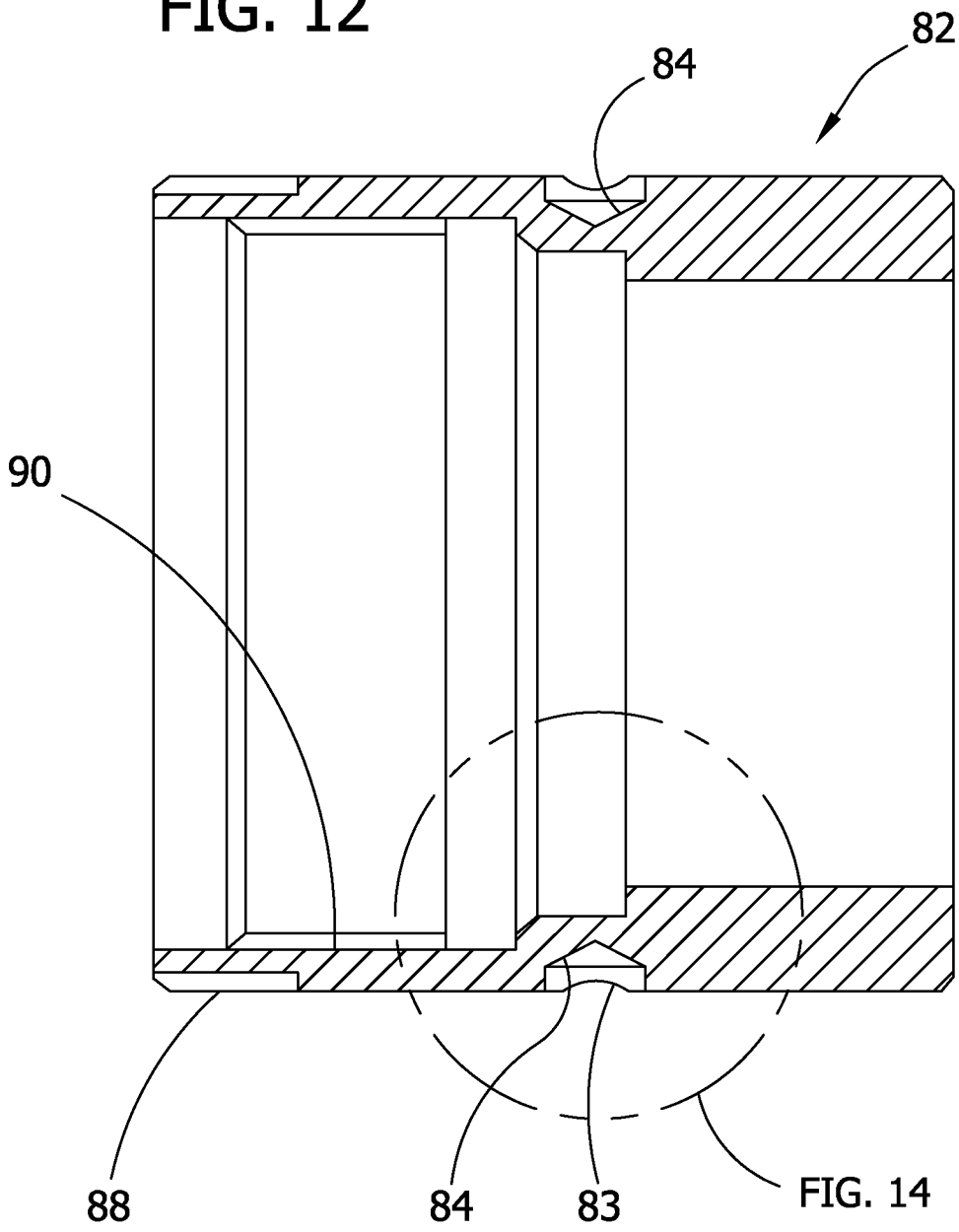
FIG. 12 is a side elevation of an inner sleeve used in the die grinder.
Figure 13:
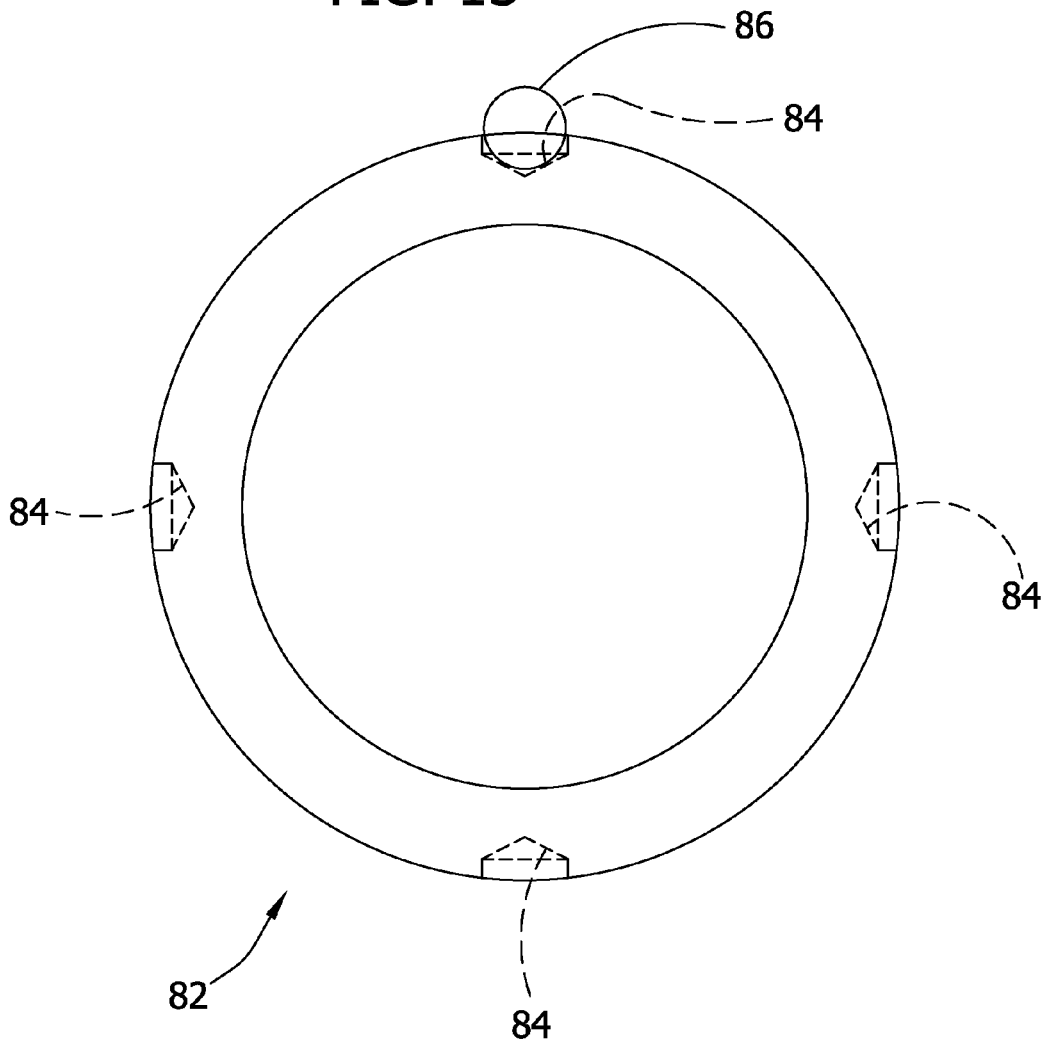
FIG. 13 is an end elevation of the inner sleeve.
Figure 14:
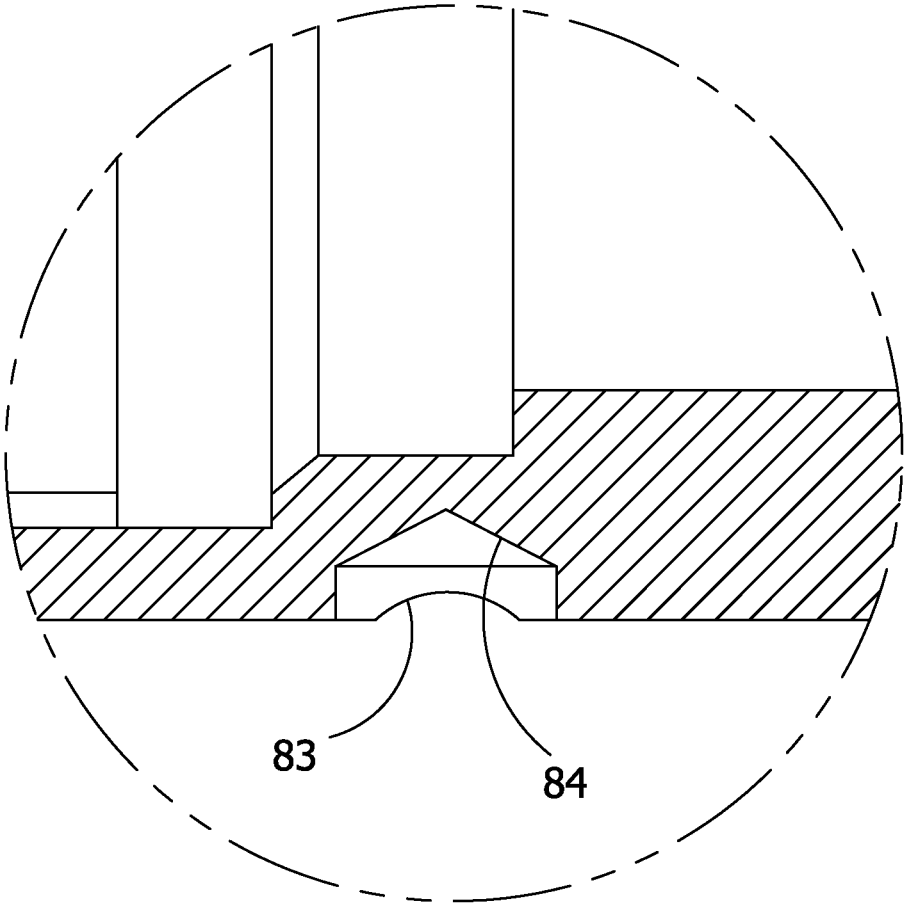
FIG. 14 is an enlarged, detail of the circled portion of FIG. 12.

The body closure member 58 is retained in position by means of an end cap 70. As shown in FIGS. 10 and 11, the end cap 70 includes a cylindrical tube 72 and a scalloped flange 74 at a distal end of the cylindrical tube. The cylindrical tube 72, which is internally sized to fit over the cylindrical tube 62 of the body closure member 58, has external threads 76 formed thereon, and the open distal end of the body 12 has internal threads (not labeled) formed therein. Thus, the end cap 70 is screwed down into the open distal end of the body 12, e.g., by means of the scalloped flange 74, and the inner edge of the cylindrical tube 72 bears against the shoulder 66 of the body closure member 58 to secure the body closure member 58 against the spacer member 68. Other means for securing the body closure member 58 within the distal end of the body 12, e.g., crimping, are possible without departing from the scope of the invention.

Figure 8:
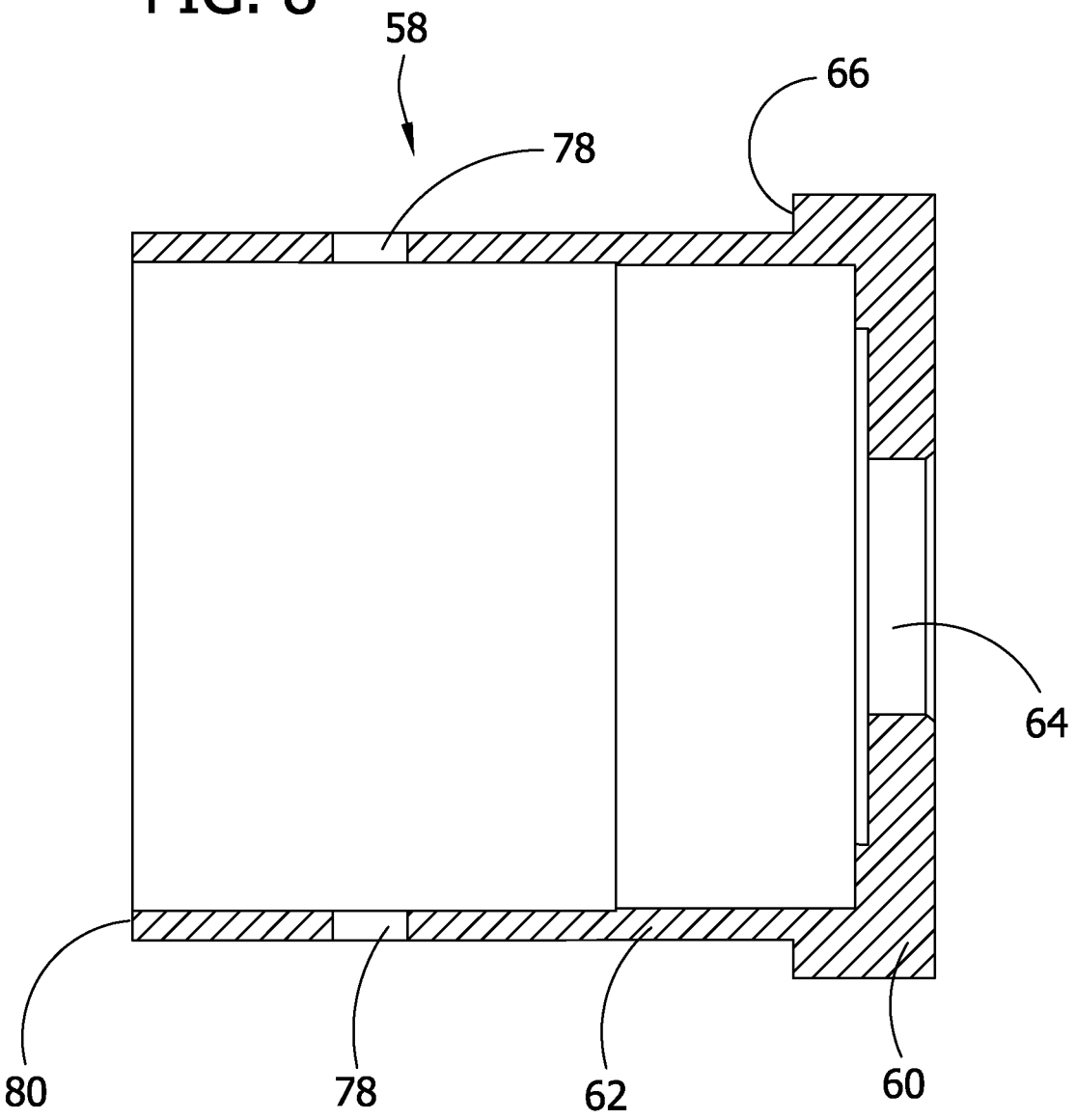
FIG. 8 is a section of a body closure member of the die grinder.
Figure 9:
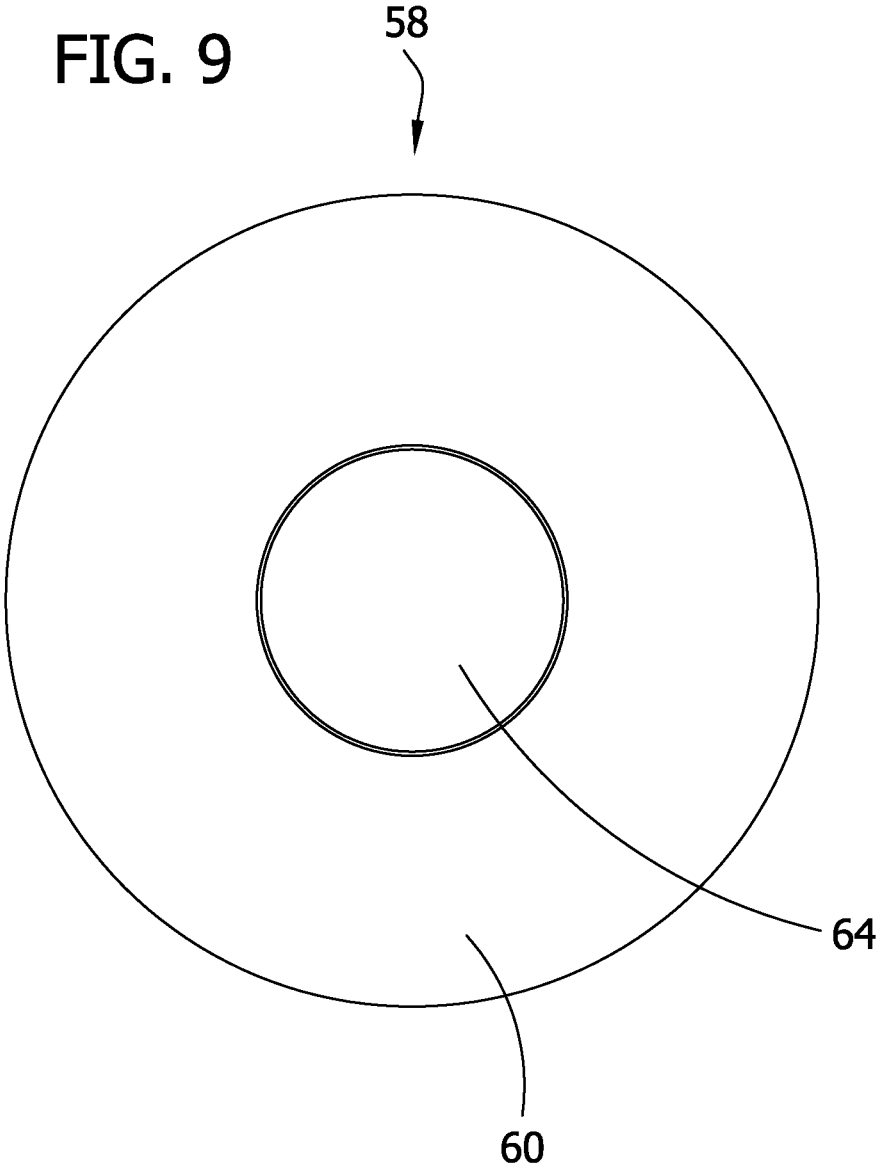
FIG. 9 is an end elevation of the body closure member.

As further shown in FIG. 8, a plurality of capture holes 78 extend through the cylindrical tube 62 of the body closure member 58. The capture holes 78 are all equally spaced from the end 80 of the cylindrical tube 62, and they are evenly spaced angularly about the circumference of the cylindrical tube 62. As the die grinder 10 is illustrated in the various figures, there are four capture holes 78 formed in the cylindrical tube 62 (only two being visible in FIG. 8), but more or fewer capture holes 78 may be provided without departing from the scope of the invention. As will become more readily apparent in view of the further disclosure below, the number of angular positions of the grinding head portion 14 relative to the body 12 is the same as the number of capture holes 78.

As further shown in FIGS. 1 and 2, a generally tubular inner sleeve 82 (broadly, a seating member) fits within the cylindrical tube 62 of the body closure member 58. As shown in greater detail in FIGS. 12-14, the inner sleeve 82 is generally cylindrical and includes an annular channel 83 on its exterior surface. Within the channel 83 at spaced apart locations are a plurality of seating dimples 84. The seating dimples extend radially inward from the floor of the channel 83 and provide seating surfaces for a number of locking spheres 86 (referred to broadly as catches), the function of which will be described in more detail below. There is the same number of seating dimples 84 as capture holes 78, and like the capture holes 78, the seating dimples 84 are evenly spaced within the channel 83 angularly about the circumference of the inner sleeve 82.

Furthermore, external threads 88 are formed on the external surface of the inner sleeve 82 at a distal end thereof, and internal threads 90 are formed on the inner surface of the inner sleeve 82 near the distal end thereof, but axially spaced slightly inwardly from the distal end of the inner sleeve 82. The distal end of the inner sleeve 82 (particularly, the interior surface thereof) and the grinding head coupling tube 30 (particularly, the exterior surface thereof) are cooperatively configured such that the grinding head coupling tube 30 screws into the distal end of the inner sleeve 82, with the external threads 33 on the grinding head coupling tube 30 engaging the internal threads 90 at the distal end of the inner sleeve 82.

As further illustrated in FIGS. 1 and 2 (which show the die grinder 10 with the grinding head portion 14 locked with respect to the body 12), a locking sphere 86 is positioned in each of the capture holes 78 in the cylindrical tube 62 of the body closure member 58, and each locking sphere 86 protrudes radially inwardly all the way through its respective capture hole 78. Thus, each locking sphere 86 seats within a respective seating dimple 84 on the exterior surface of the inner sleeve 82. The capture holes 78 can be slightly larger in diameter than the locking spheres 86, but not so large that the locking spheres roll around loosely therein.

Figure 15:
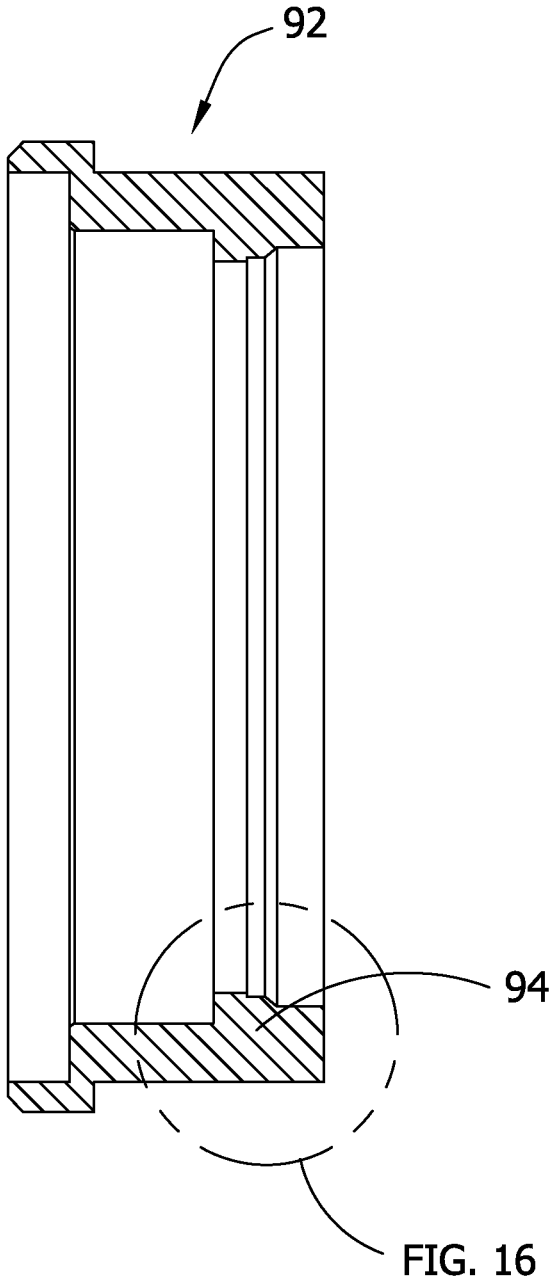
FIG. 15 is a section of an outer sleeve of the die grinder.
Figure 16:
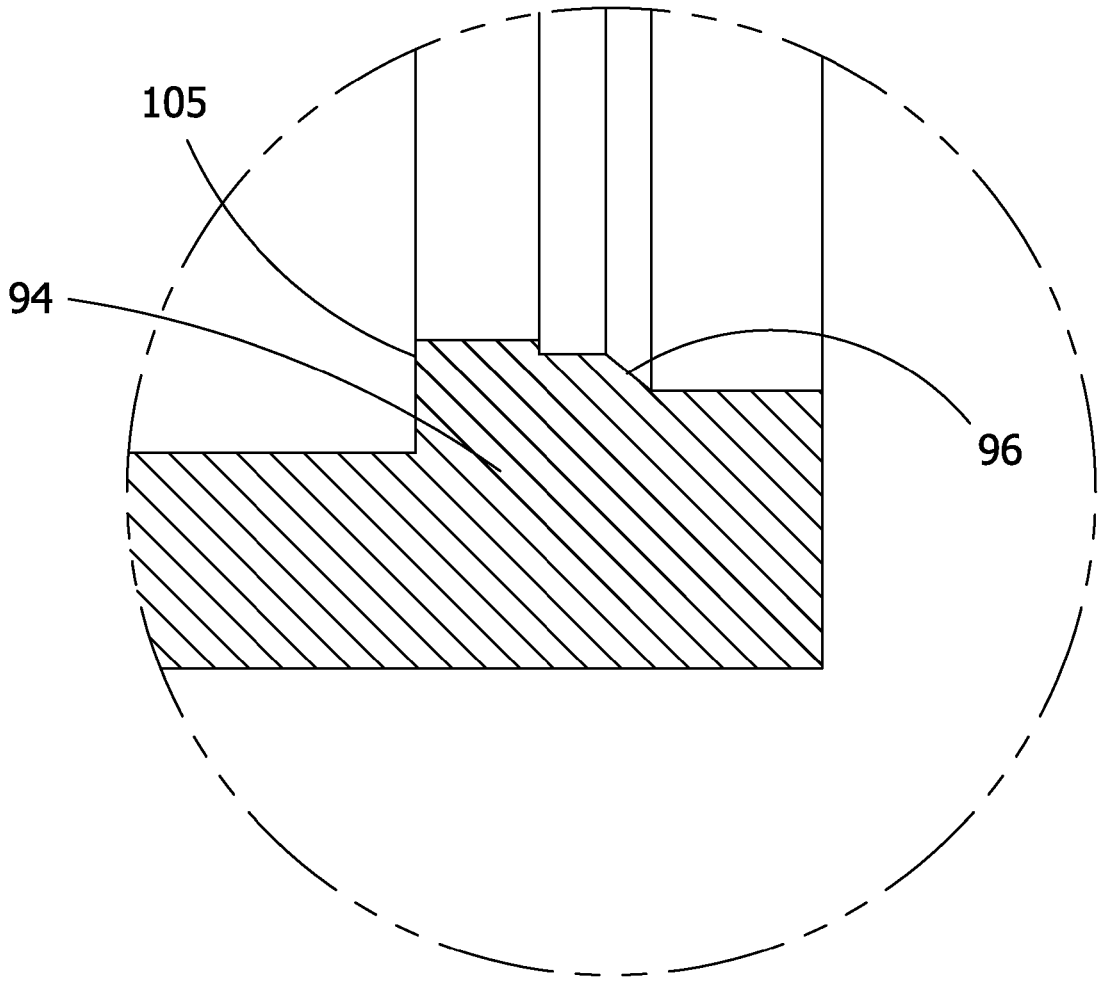
FIG. 16 is an enlarged, detail of the circled portion of FIG. 15.

A movable outer sleeve 92 (broadly, a retaining member) surrounds the cylindrical tube 62, as shown in FIGS. 1 and 2. As shown in greater detail in FIGS. 15 and 16, the outer sleeve 92 is a generally cylindrical tube, with a ridge 94 extending radially inwardly from an inner surface thereof at a generally medial axial position. The ridge 94 suitably has a beveled camming surface 96, the benefit of which will be made clearer below. The inner diameter of the portion of the outer sleeve 92 that is located distally of the ridge 94 (i.e., to the left of the ridge as shown in FIG. 15) is greater than the outer diameter of the cylindrical tube 62 such that a first annular space 98 is formed between the cylindrical tube 62 and the outer sleeve. Similarly, the inner diameter of the portion of the outer sleeve 92 that is located proximally of the ridge 94 (i.e., to the right of the ridge 94 as shown in FIG. 15) is greater than the outer diameter of the cylindrical tube 62 such that a second annular space 100 is formed between the cylindrical tube 62 and the outer sleeve 92. The distalmost end of the outer sleeve 92 is slightly flared, such that the inner diameter thereof is larger than the inner diameter of the rest of the outer sleeve 92.

Figure 17:
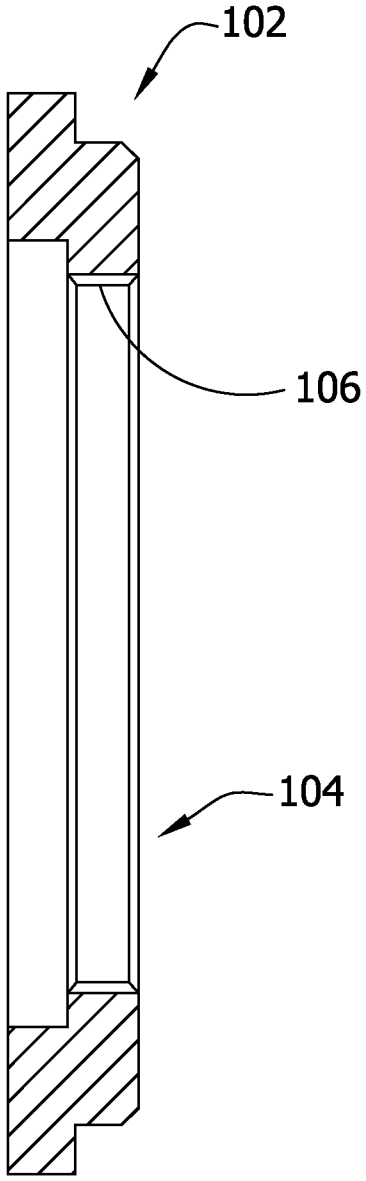
FIG. 17 is a side view, partially in section, of an end ring of the die grinder.

An end ring 102 is further provided. As shown in FIG. 17, the end ring 102 is a generally thin hat-shaped member with a central hole 104, and internal threads 106 are formed around the central hole 104. The end ring 102 is threaded onto the distal end of the inner sleeve 82, with internal threads 106 engaging the external threads 88 on the distal end of the inner sleeve 82. The end ring 102 is positioned in abutment with the distalmost surface of the inner sleeve 82. The end ring limits the amount the movable outer sleeve 92 can be moved. A screw 108 in the back of the grinding head portion 14 is engageable with the end ring 102 to maintain spacing between the end ring and the movable outer sleeve 92 so that the outer sleeve cannot be moved toward the grinding head 14 so far that the locking spheres 86 might fall out. Other ways of maintaining such a maximum spacing do not depart from the scope of the present invention.

A helical spring 112 is provided within the first annular space 98, surrounding the cylindrical tube 62 of the body closure member 58. The helical spring 112 is disposed between and bears against the end ring 102 at one end and a bearing surface 104 on the ridge 94 within the outer sleeve 92 at its opposite end. Thus, the helical spring 112 biases the moveable outer sleeve 92 proximally (i.e., to the right as shown in FIGS. 1 and 2), with proximal movement of the outer sleeve 92 limited by abutment of the outer sleeve 92 with the flange 74 of the end cap 70.

The position of the outer sleeve 92 shown in FIGS. 1 and 2 is a locking position thereof, and the various components are mutually sized and configured such that ridge 94 surrounds and bears against the locking spheres 86 when the outer sleeve 92 is in the locking position. In that position, the ridge 94 secures the locking spheres 86 in the seating dimples 84. Thus, the locking spheres 86 prevent the inner sleeve 82—and hence the grinding head coupling tube 32, which is screwed into the distal end of the inner sleeve 82—from rotating within the cylindrical tube 62 of the body closure member 58 about the longitudinal axis of the die grinder 10.

To change the angular orientation of the grinding head portion 14 (i.e., to rotate it about the longitudinal axis of the die grinder 10), the outer sleeve 92 is moved distally (i.e., to the left, as shown in FIGS. 1 and 2) against the biasing force of the helical spring 112 to an unlocking position. Distal movement of the outer sleeve 92 is limited by abutment and registration of the flared distal end of the outer sleeve 92 with the end ring 102. Such distal movement of the outer sleeve 92 removes the ridge 94 from overlying the locking spheres 86. At that point, the grinding head portion 14 may be rotated about the longitudinal axis of the die grinder 10, which rotation causes the inner sleeve 82 to rotate within the cylindrical tube 62. As the inner sleeve 82 rotates within the cylindrical tube 62, the body structure of the inner sleeve 82 surrounding the seating dimples 84 forces the locking spheres 86—which are restrained against circumferential movement by the capture holes 78—to move radially and rise up out of the seating dimples 84, thus to protrude slightly into the second annular space 100 between the outer sleeve 92 and the cylindrical tube 62. It will be appreciated that the second annular space 100 is large enough to permit the locking spheres 86 to rise completely out of and clear the seating dimples 84, yet small enough to prevent the locking spheres from passing radially completely out of the channel 83 or the capture holes 78. Thus, the inner sleeve 82 will be freed to rotate beneath the locking spheres 86 when the outer sleeve 92 is moved distally.

Once the grinding head portion 14 has been rotated to the desired angular position, the outer sleeve 92 is released, and the helical spring 112 biases it back toward the locked position. The camming surface 96 of the ridge 94 will bear against the locking spheres 86, thus pushing the locking spheres out of the second annular space 100 and back down into the seating dimples 84. Thus, the grinding head portion 14 will once again be locked in its new angular position. From the foregoing, it will be appreciated that the mechanism by means of which the grinding head portion is released and secured is essentially a locking detent mechanism.

Figure 18:
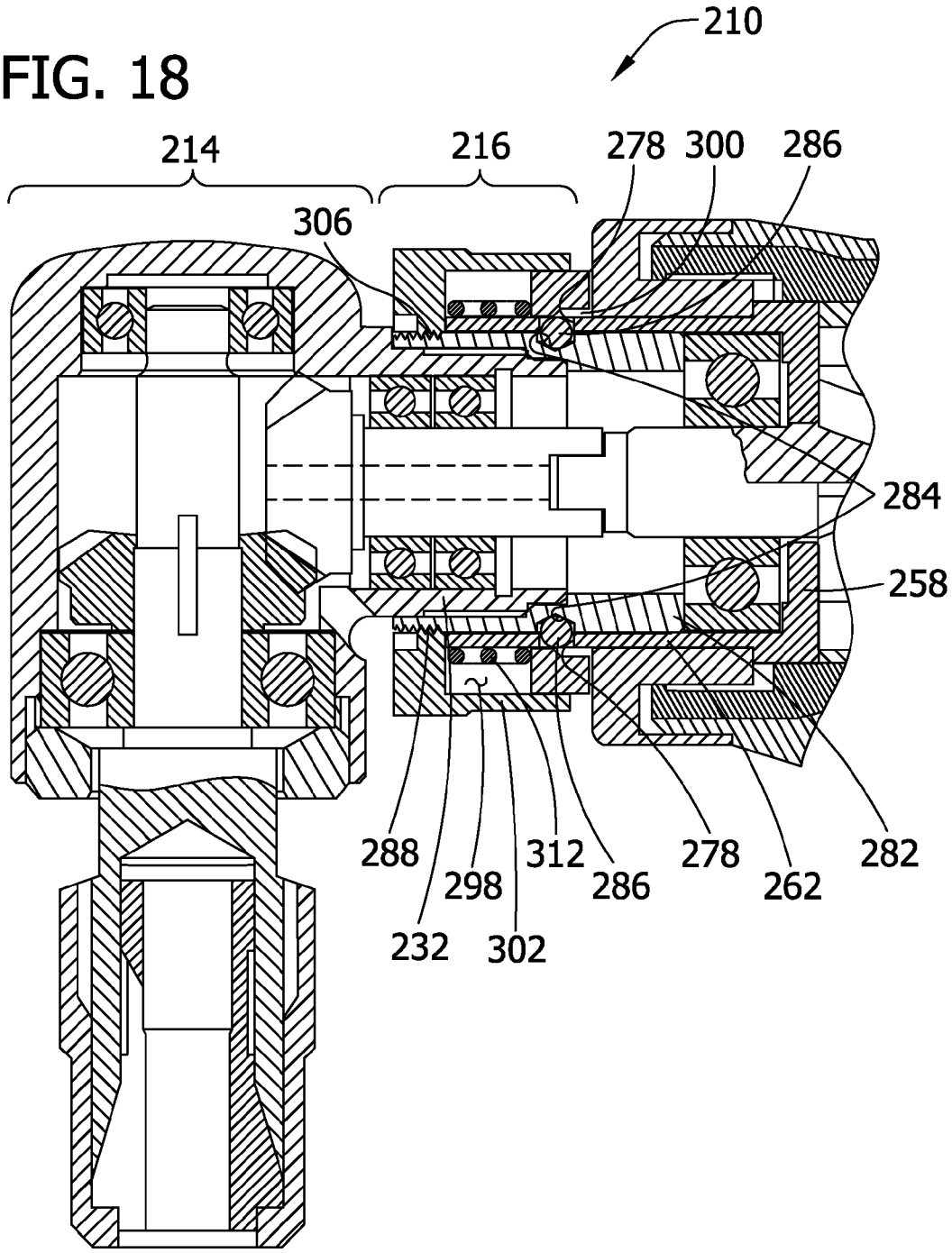
FIG. 18 is an enlarged, fragmentary section similar to FIG. 2 but showing a die grinder having a different locking interconnect portion.

Referring now to FIG. 18, a fragmentary portion of a die grinder 210 similar to the die grinder 10 of FIG. 1 is shown. Corresponding parts of the die grinder 210 will be given the same reference numerals as for the die grinder 10. Moreover, the construction of many parts of the die grinder 210 which are the same in the illustrated embodiment as that of die grinder 10 will not be described again. A primary distinction between the die grinder 210 and the die grinder 10 is in the construction of the locking interconnect portions (216 and 16). It is to be understood that there can be other differences between the grinder 210 and the grinder 10 without departing from the scope of the present invention.

The locking interconnect portion 216 includes a locking sphere 286 positioned in each of the capture holes 278 in the cylindrical tube 262 of the body closure member 258, and each locking sphere protrudes radially inwardly all the way through its respective capture hole. Thus, each locking sphere 286 seats within a respective seating dimple 284 on the exterior surface of the inner sleeve 282. In that regard, the construction is closely similar to that of die grinder 10.

Figure 19:
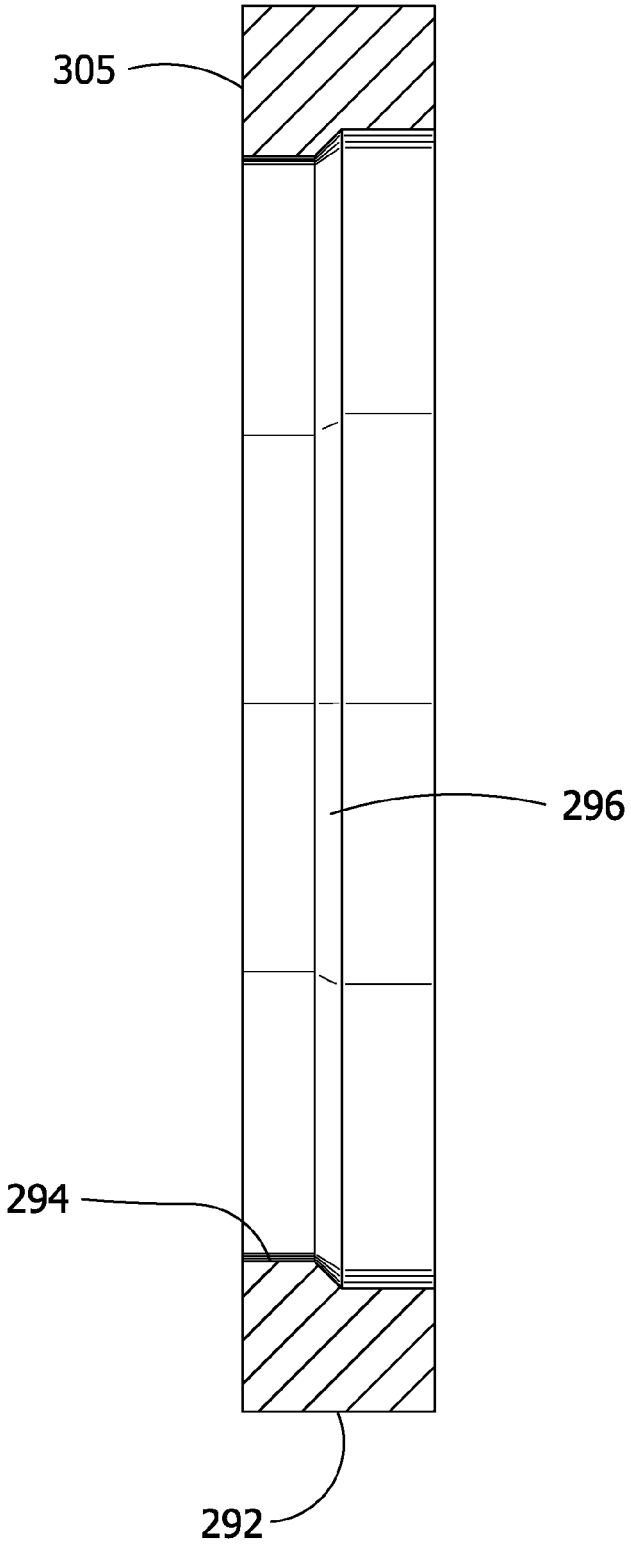
FIG. 19 is a section of a retaining ring of the die grinder of FIG. 18.

A movable retaining ring 292 (broadly, a retaining member) surrounds the cylindrical tube 262. As shown in greater detail in FIG. 19, the retaining ring 292 has a ridge 294 extending radially inwardly from an inner surface thereof at a generally medial axial position. The ridge 294 has a beveled camming surface 296 immediately adjacent to the ridge, the benefit of which will be made clearer below. The inner diameter of the portion of the retaining ring 292 that is located proximally of the ridge 294 (i.e., to the right of the ridge 294 as shown in FIG. 19) is greater than the outer diameter of the cylindrical tube 262 such that an annular space 300 (FIG. 18) is formed between the cylindrical tube and the retaining ring. It will be appreciated that the retaining ring 292 differs from the movable outer sleeve 92 in that the structure of the sleeve distal of the ridge 94 is not present in the retaining ring. Moreover as will be described more fully, the retaining ring 292 is not located in an (outer) position where it can be grasped and moved by the user.

Figure 20:
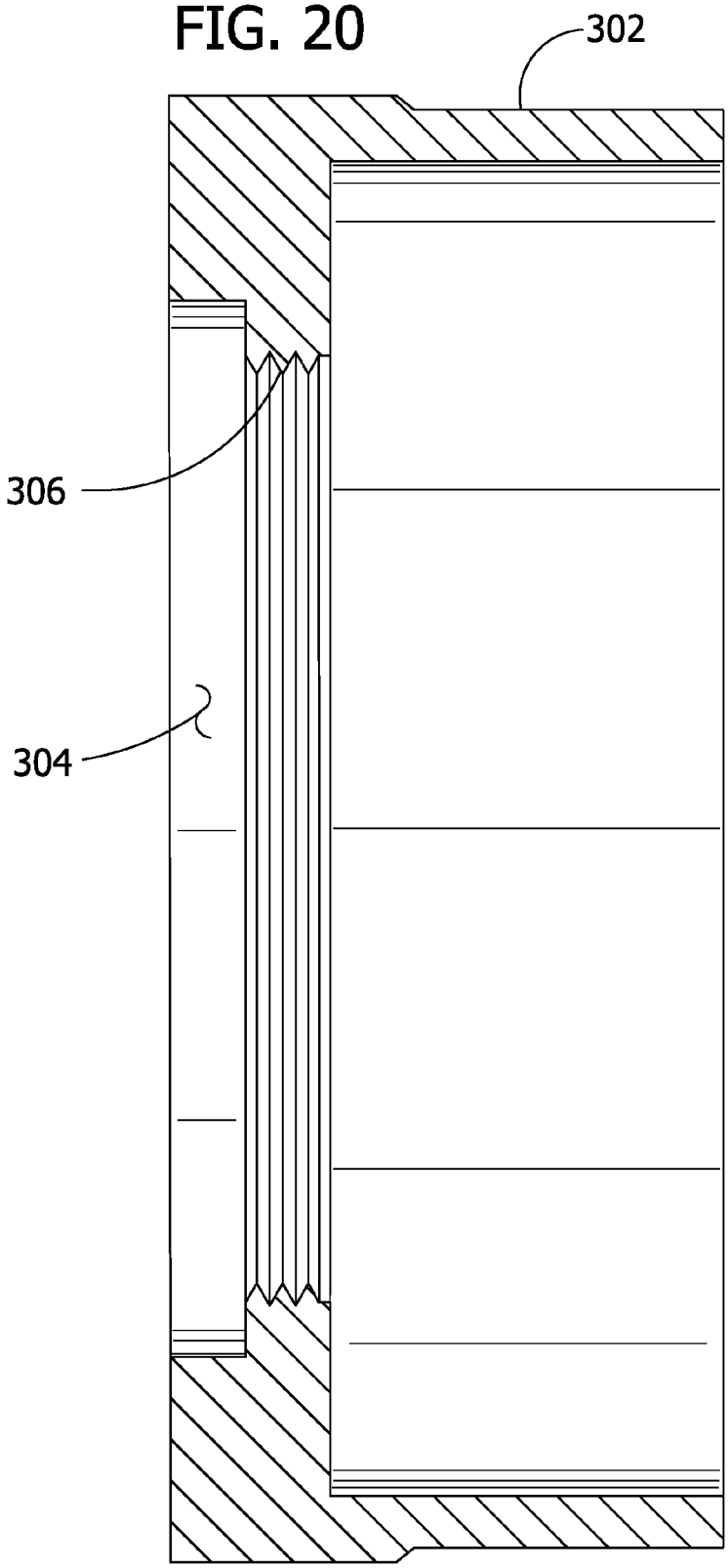
FIG. 20 is a section of a release cap of the die grinder of FIG. 18.

In place of the end ring 102 of the die grinder 10, the die grinder 210 has a tubular release cap 302. As shown in FIG. 20, the release cap 302 has a generally inverted cup shape with a central hole 304, and internal threads 306 are formed around the central hole. The release cap 302 is threaded onto the distal end of the inner sleeve 282, with internal threads 306 engaging external threads 288 on the distal end of the inner sleeve 282. The release cap 302 has an interior cavity that is larger in diameter than the cylindrical tube 262 of the closure member 258 to define an annular space 298.

A helical spring 312 provided within the annular space 298 is disposed between and bears against the release cap 302 at one end and a bearing surface 305 on the retaining ring 292. Thus, the helical spring 312 biases the retaining ring 292 proximally (i.e., to the right as shown in FIG. 18). In this configuration, the retaining ring 292 is in a locking position in which the ridge 294 surrounds and bears against the locking spheres 286. In the locking position, the ridge 294 secures the locking spheres 286 in the seating dimples 284. Thus, the locking spheres 286 prevent the inner sleeve 282—and hence the grinding head coupling tube 232, which is screwed into the distal end of the inner sleeve 282—from rotating within the cylindrical tube 262 of the body closure member 258 about the longitudinal axis of the die grinder 210.

To change the angular orientation of the grinding head portion 214 (i.e., to rotate it about the longitudinal axis of the die grinder 210), the release cap 302 is unscrewed so that it moves distally (to the left as seen in FIG. 18) relative to the retaining ring 292. This movement increases the axial length of the space 298 in which the spring 312 resides. Thus, the spring force exerted by the spring 312 on the retaining ring 292 is reduced. When a torque is subsequently applied to turn the head 232 the locking spheres are subject to a force radially outward from the retaining holes 278 and dimples 284. The locking spheres 286 bear against the retaining ring 292. The reduced force of the spring 312 allows the retaining ring 292 to move distally. This movement is aided by engagement of the locking spheres 286 with the camming surface 296.

Such distal movement of the retaining ring 292 removes the ridge 294 from overlying the locking spheres 286. At that point, the grinding head portion 214 may be rotated about the longitudinal axis of the die grinder 210, which rotation causes the inner sleeve 282 to rotate within the cylindrical tube 262. As the inner sleeve 282 rotates within the cylindrical tube 262, the body structure of the inner sleeve surrounding the seating dimples 284 forces the locking spheres 286—which are restrained against circumferential movement by the capture holes 278—to move radially and rise up out of the seating dimples, thus to protrude slightly into the annular space 300 between the outer sleeve 292 and the cylindrical tube 262. It will be appreciated that the annular space 300 is large enough to permit the locking spheres 286 to rise completely out of and clear the seating dimples 284, yet small enough to prevent the locking spheres from passing radially completely out of the capture holes 278. Thus, the inner sleeve 282 is freed to rotate beneath the locking spheres 286 when the retaining ring 92 is moved distally.

Once the grinding head portion 214 has been rotated to the desired angular position, the release cap 302 is screwed back down (proximally) to the position shown in FIG. 18. This reduces the axial length of the space 298 and compresses the spring 312 against the retaining ring 292 pushing the ring back toward the locking position. The camming surface 296 of the ridge 294 bears against the locking spheres 86, pushing them out of the annular space 300 and back down into respective seating dimples 284. Thus, the grinding head portion 214 will be locked in its new angular position against rotation. The spring force of the spring 312 is now too great to permit the retaining ring 292 to be moved distally under an applied torque on the head portion 214.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A tool comprising:

a body having a longitudinal axis;

a head including a rotary mechanism with an output member capable of powered rotation;

a motor disposed in the body and operatively connected to the rotary mechanism for rotating the output member; and a locking interconnect for attaching the head to the body, the locking interconnect being adapted to selectively permit rotation of the head relative to the body about the longitudinal axis of the body without changing a longitudinal position of the output member with respect to the body while maintaining connection between the head and the body, and to selectively prevent rotation of the head relative to the body when in each angular position of a plurality of angular positions relative to the longitudinal axis of the body, the locking interconnect including a locking detent mechanism, comprising:

a seating member with seating dimples formed thereon;

a capture member surrounding said seating member and having capture holes formed therethrough;

catches disposed within said capture holes; and a retaining member surrounding said capture member;

a release cap; and a spring disposed between the release cap and the retaining member for biasing the retaining member, the release cap being threadably attached to the body and positioned for selectively changing the force applied by the spring on the retaining member.

2. A tool as set forth in claim 1, wherein the locking detent mechanism is adapted for quick release.

3. A tool as set forth in claim 1, wherein said retaining member slides axially between a locking position and an unlocking position.

4. A tool as set forth in claim 3, wherein said retaining member is biased toward said locking position.

5. A tool as set forth in claim 1, wherein said catches comprise locking spheres.

6. A tool as set forth in claim 1, wherein said retaining member comprises a tubular sleeve with a radially inwardly protruding ridge formed on an inner surface thereof.

7. A tool as set forth in claim 1, wherein the tool is a pneumatic tool and the motor comprises an air motor, the tool further comprising a power transmission extending from the air motor through the locking interconnect to the output member.

8. A tool as set forth in claim 1, wherein the output member rotates about an axis which is not coincident with and not parallel to the longitudinal axis of the body.

9. A tool as set forth in claim 1, wherein the sleeve is configured for sliding movement along the longitudinal axis of the body causing radial movement of the detent.

10. A tool as set forth in claim 1, wherein the locking interconnect comprises a camming surface for urging the head into a locked configuration.

11. A pneumatic grinding tool comprising:

a body having a longitudinal axis;

a grinding head including a rotary mechanism with an output member capable of powered rotation;

an air motor disposed in the body and operatively connected to the rotary mechanism for rotating the output member;

an air inlet for being coupled with a source of pressurized air for powering the air motor;

a locking interconnect for attaching the grinding head to the body, the locking interconnect being adapted to selectively permit rotation of the grinding head relative to the body about the longitudinal axis of the body without changing a longitudinal position of the output member with respect to the body while maintaining connection between the head and the body, and to selectively prevent rotation of the head relative to the body when in each angular position of a plurality of angular positions relative to the longitudinal axis of the body, the locking interconnect including a locking detent mechanism, comprising:

a seating member with seating dimples formed thereon;

a capture member surrounding said seating member and having capture holes formed therethrough;

catches disposed within said capture holes; and a retaining member surrounding said capture member;

a release cap; and a spring disposed between the release cap and the retaining member for biasing the retaining member, said release cap being threadably attached to the body and positioned for selectively changing the force applied by the spring on the retaining member.

12. A pneumatic grinding tool as set forth in claim 11, wherein the locking detent mechanism is adapted for quick release.

13. A powered tool comprising:

a body having a longitudinal axis;

a head including a rotary mechanism with an output member capable of powered rotation;

a motor disposed in the body and operatively connected to the rotary mechanism for rotating the output member; and a locking interconnect for attaching the head to the body, the locking interconnect being adapted to selectively permit rotation of the head relative to the body generally about the longitudinal axis of the body without changing a longitudinal position of the output member with respect to the body while maintaining connection between the head and the body, and to selectively prevent rotation of the head relative to the body when in each angular position of a plurality of angular positions relative to the longitudinal axis of the body, the locking interconnect including a locking detent mechanism, comprising:

a seating member with seating dimples formed thereon;

a capture member surrounding said seating member and having capture holes formed therethrough;

catches disposed within said capture holes; and a retaining member surrounding said capture member;

a release cap; and a spring disposed between the release cap and the retaining member for biasing the retaining member, said release cap being threadably attached to the body and positioned for selectively changing the force applied by the spring on the retaining member.

14. A hand-held tool comprising:

a body having a longitudinal axis;

a head including a rotary mechanism with an output member capable of powered rotation;

a motor disposed in the body and operatively connected to the rotary mechanism for rotating the output member; and a locking interconnect for attaching the head to the body, the locking interconnect being adapted to selectively permit rotation of the head relative to the body generally about the longitudinal axis of the body without changing a longitudinal position of the output member with respect to the body while maintaining connection between the head and the body, and to selectively prevent rotation of the head relative to the body when in each angular position of a plurality of angular positions relative to the longitudinal head of the body, the locking interconnect including a locking detent mechanism, comprising:

a seating member with seating dimples formed thereon;

a capture member surrounding said seating member and having capture holes formed therethrough;

catches disposed within said capture holes; and a retaining member surrounding said capture member;

a release cap; and a spring disposed between the release cap and the retaining member for biasing the retaining member, said release cap being threadably attached to the body and positioned for selectively changing the force applied by the spring on the retaining member.

* * * * *